US006915967B1

(12) United States Patent
Chen

(10) Patent No.: US 6,915,967 B1
(45) Date of Patent: Jul. 12, 2005

(54) FLOW CONTROL DEVICE AND TRIGGER DEVICE OF SPRINKLER NOZZLE STRUCTURE

(75) Inventor: Chin-Yuan Chen, Taichung (TW)

(73) Assignee: Shin Tai Spurt Water of the Garden Tools Co., Ltd., Changhua Hsien (TW)

( * ) Notice: Subject to any disclaimer, the term of this patent is extended or adjusted under 35 U.S.C. 154(b) by 97 days.

(21) Appl. No.: 10/622,554

(22) Filed: Jul. 21, 2003

(51) Int. Cl.[7] ..... B05B 9/08; B05B 9/01; B05B 1/30

(52) U.S. Cl. ..... 239/530; 239/525; 239/526; 239/569; 239/572; 239/579; 239/581.1

(58) Field of Search ..... 239/525, 526, 239/530, 280, 569, 572, 579, 581.1

(56) References Cited

U.S. PATENT DOCUMENTS 5,662,276 A * 9/1997 Ko ..... 239/571
5,975,429 A * 11/1999 Jezek ..... 239/124
6,454,187 B1 * 9/2002 Wang ..... 239/526
6,520,427 B1 * 2/2003 Chen ..... 239/526
6,540,163 B1 * 4/2003 Huang ..... 239/587.5
6,568,605 B1 * 5/2003 Chen ..... 239/525

* cited by examiner

*Primary Examiner*—Robin O. Evans
(74) *Attorney, Agent, or Firm*—Alan D. Kamrath; Nikolai & Mersereau, P.A.

(57) ABSTRACT

A sprinkler nozzle structure comprises a grip, a barrel, a spray nozzle, a trigger device, and a flow control device. The trigger device is fastened with the grip for clogging and unclogging a water channel of the grip. The flow control device is fastened between the grip and the barrel for regulating the flow of water moving from the water channel of the grip into a water channel of the barrel.

1 Claim, 5 Drawing Sheets

FLOW CONTROL DEVICE AND TRIGGER DEVICE OF SPRINKLER NOZZLE STRUCTURE

BACKGROUND OF THE INVENTION

1. Field of the Invention

The present invention relates generally to a sprinkler nozzle structure, and more particularly to a flow control device and a trigger device of the sprinkler nozzle structure.

2. Description of Related Art

The conventional sprinkler nozzle structure generally comprises a flow control device and a trigger device, which are structurally incorporated and are therefore complicated in construction, thereby resulting in an increase in production cost of the conventional sprinkler nozzle structure. The combination of the control device and the trigger device into one structural unit makes the conventional sprinkler nozzle structure vulnerable to mechanical failure.

SUMMARY OF THE INVENTION

The primary objective of the present invention is to provide a sprinkler nozzle structure comprising a flow control device and a trigger device, which are structurally independent of each other.

The foregoing objective of the present invention is attained by a sprinkler nozzle structure comprising a grip, a barrel, a spray nozzle, a flow control device, and a trigger device. The grip and the barrel are provided in the interior with a water channel. The grip and the barrel are connected by the flow control device. The spray nozzle is connected with the barrel. The trigger device is disposed in a midsegment of the grip. The flow control device comprises a control tube and a control knob. The control tube is provided in the side wall of an inner end with two through holes which are opposite to each other and are in alignment with the water channel of the grip and the water channel of the barrel. The control tube is fastened at an outer end with the control knob by which the control tube is rotated such that the two through holes of the control tube are in a complete or partial alignment with the water channels, thereby resulting in flow control. The trigger device comprises a trigger, an actuation rod, and an action rod. The action rod is located in the water channel of the grip and is actuated by the actuation rod at the time when the trigger is activated, thereby resulting in separation of a stop edge of the action rod from an arresting surface of the inner wall of the water channel of the grip.

The features and the advantages of the present invention will be more readily understood upon a thoughtful deliberation of the following detailed description of the present invention with reference to the accompanying drawings.

DETAILED DESCRIPTION OF THE INVENTION

Figure 1:
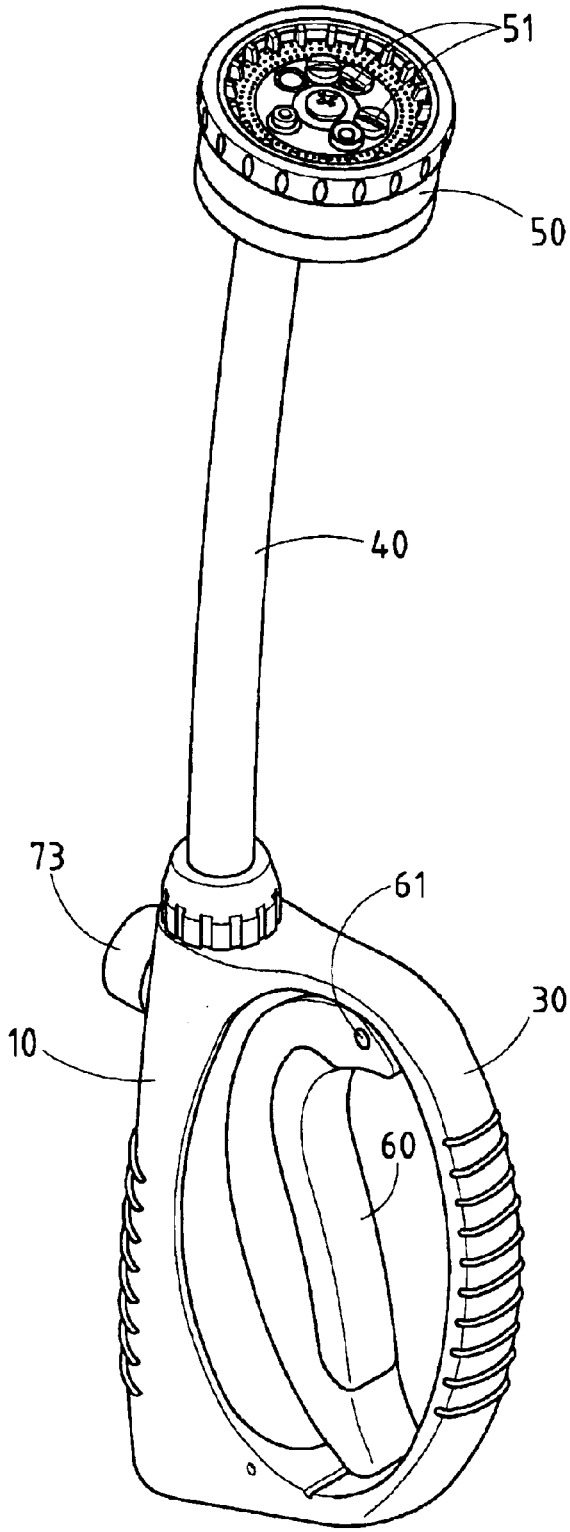
FIG. 1 shows a perspective view of the present invention.
Figure 2:
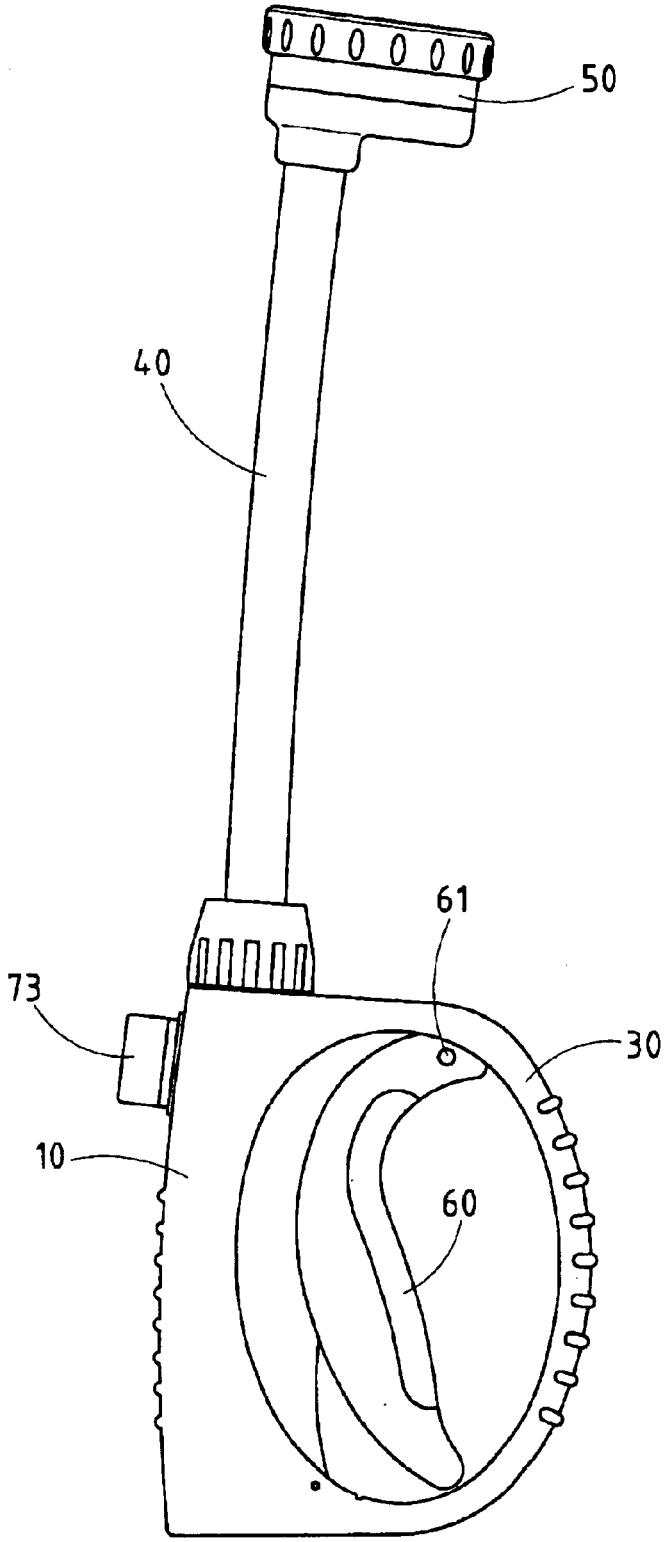
FIG. 2 shows a side schematic plan view of the present invention.

As shown in FIGS. 1–4, a sprinkler nozzle structure of the present invention comprises a grip 10, a barrel 40, a spray nozzle 50, a trigger 60, and a trigger guard 30.

The grip 10 is provided in the interior with a water channel 11 extending in the longitudinal direction of the grip 10. The grip 10 is provided at a bottom end with a hose connector 12 in communication with the water channel 11. The water channel 11 is provided in the inner wall of a midsegment thereof with an annular arresting surface 13.

Figure 3:
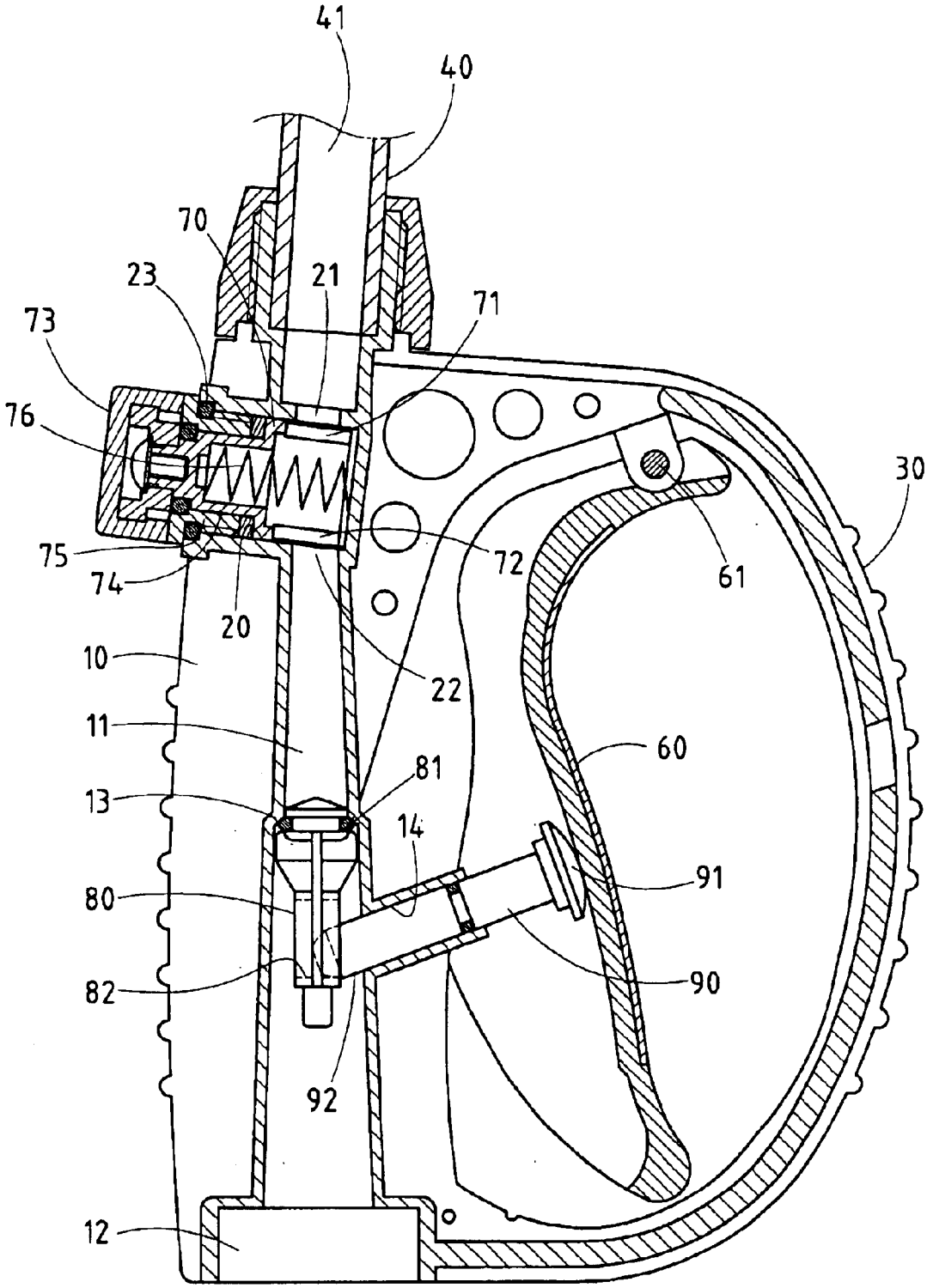
FIG. 3 shows a sectional schematic view of the present invention in the "OFF" state.
Figure 4:
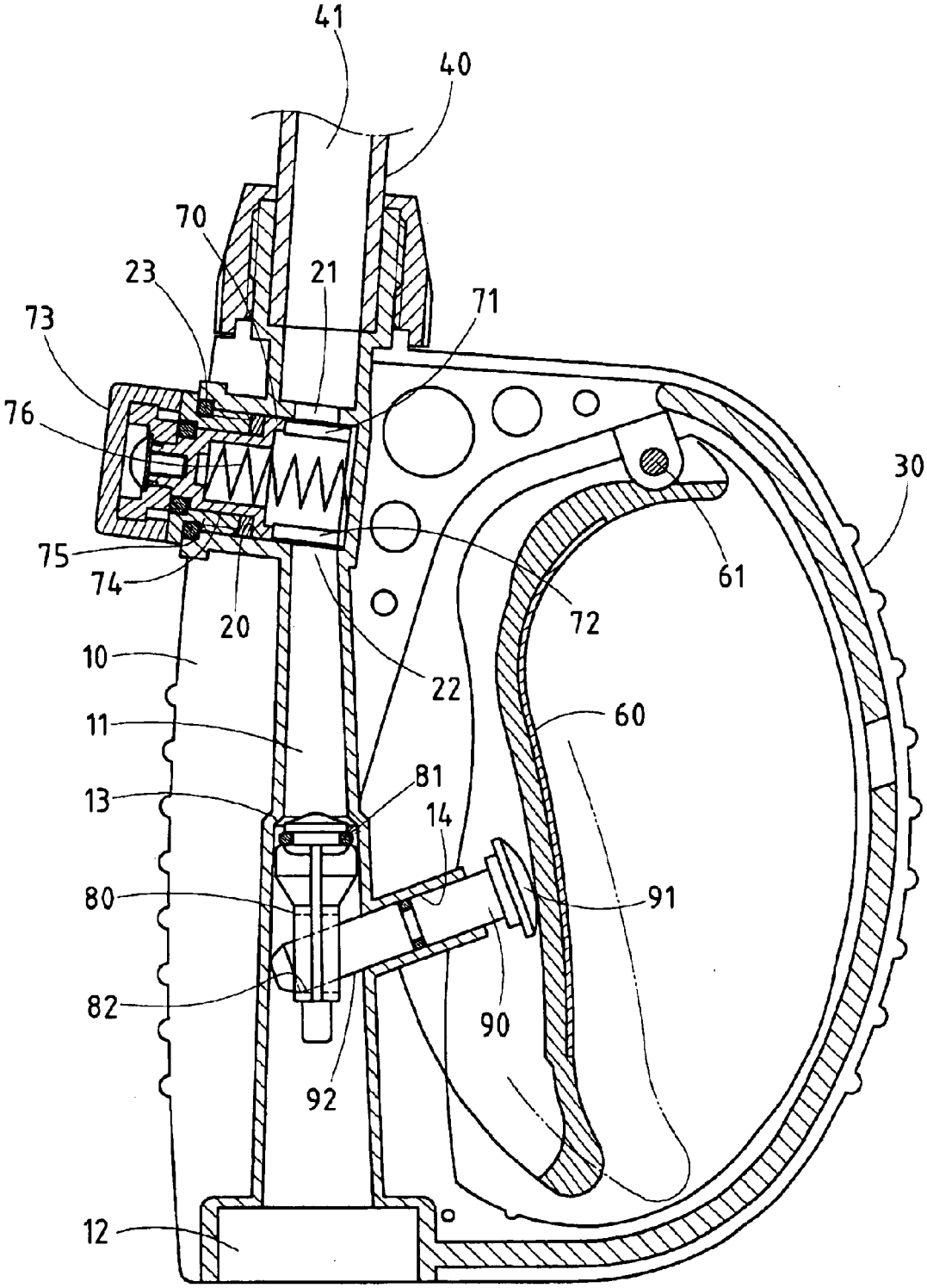
FIG. 4 shows a sectional schematic view of the present invention in the "ON" state.

The present invention further comprises a trigger device which is structurally associated with the grip 10. The trigger device comprises a trigger 60, an action rod 80, and an actuation rod 90. The trigger 60 is pivoted with the grip 10 by a pivot 61. The action rod 80 is provided at a top end with a stop edge 81, and at a bottom end with a locating slot 82. The action rod 80 is disposed in the water channel 11 of the grip 10 such that the action rod 80 is forced by the water pressure to move upward, thereby causing the stop edge 81 to come in contact with the arresting surface 13 of the water channel 11, as shown in FIG. 3. The actuation rod 90 is provided with an inner end 92 which is located in the locating slot 82 of the action rod 80. The actuation rod 90 is further provided with an outer end 91 which comes in contact with the trigger 60. As the trigger 60 is activated, the action rod 80 is actuated by the actuation rod 90, thereby resulting in separation of the stop edge 81 of the action rod 80 from the arresting surface 13 of the inner wall of the water channel 11 of the grip 10, as shown in FIG. 4. As a result, the water can flow freely in the water channel 11 without being obstructed. It must be noted here that the grip 10 is provided with a slanted side tube 14 in communication with the water channel 11. The actuation rod 90 is accommodated in the slanted side, tube 14.

The barrel 40 is provided in the interior with a water channel 41 in communication with the spray nozzle 50 which is fastened with an outer end of the barrel 40 and is provided with a plurality of jet nozzles 51 for emitting water in the form of a spray.

Figure 5:
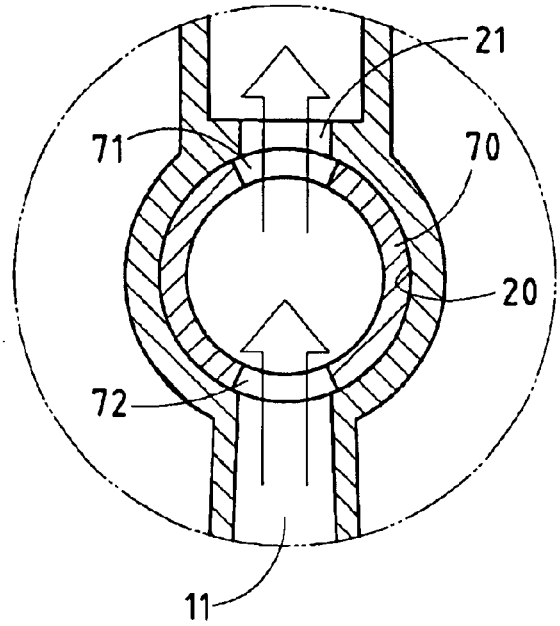
FIG. 5 shows a schematic view of the two through holes of the control tube in a complete alignment with the water channels of the present invention.
Figure 6:
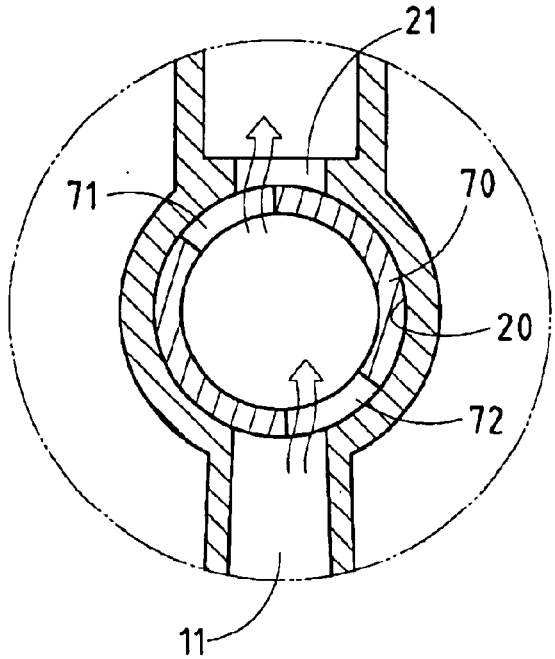
FIG. 6 shows a schematic view of the two through holes of the control tube in a partial alignment with the water channels of the present invention.

A flow control device is located between an inner end of the barrel 40 and a top end of the grip 10. The control device comprises a housing 20, a control tube 70, a spring 76, and a control knob 73 which is fastened with an outer end 74 of the control tube 70 in conjunction with a fastening ring 75. The housing 20 is provided with an upper through hole 21 in communication with the water channel 41 of the barrel 40. The housing 20 is further provided with a lower through hole 22 in communication with the water channel 11 of the grip 10. In another words, the two through holes 21 and 22 of the housing 20 are in alignment with the water channels 11 and 41. The control tube 70 is provided with an upper through hole 71 and a lower through hole 72. The control tube 70 is rotatably disposed in the housing 20 such that the upper through hole 71 is corresponding in location to the upper through hole 21 of the housing 20, and that the lower through hole 72 of the control tube 70 is corresponding in location to the lower through hole 22 of the housing 20. The spring 76 is disposed in the control tube 70 such that an outer end of the spring 76 urges the inner wall of an outer end of the control tube 70, and that an inner end of the spring 76 urges the inner wall of an inner end of the housing 20. As the control tube 70 is turned by the control knob 73 in such a way that the upper through hole 71 of the control tube 70 is in a complete alignment with the upper through hole 21 of the housing 20, and that the lower through hole 72 of the control tube 70 is in a complete alignment with the lower through hole 22 of the housing 20, as illustrated in FIG. 5, the water flow is greatest. When the control tube 70 is turned by the control knob 73 such that the through holes 71 and 72 are in a partial alignment with the through holes 21 and 22 of the housing 20, as illustrated in FIG. 6, the water flow is reduced.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claim.

I claim:

1. A sprinkler nozzle structure comprising:

a grip provided in an interior with a water channel extending along a longitudinal direction thereof, said grip further provided at a bottom end with a hose connector in communication with said water channel;

a trigger device fastened with said grip to clog and unclog said water channel of said grip;

a barrel provided in an interior with a water channel;

a flow control device fastened between a top end of said grip and an inner end of said barrel for regulating the flow of water moving from said water channel of said grip into said water channel of said barrel; and a spray nozzle fastened with an outer end of said barrel for emitting the water in the form of a spray;

wherein said trigger device comprises:

an arresting surface disposed in an inner wall of a midesgment of said water channel of said grip;

an action rod provided at a top end with a stop edge, and at a bottom end with a locating slot whereby said action rod is movably disposed in said water channel of said grip such that said stop edge of said action rod is in contact with said arresting surface of said water channel of said grip, so as to clog said water channel, an actuation rod movably disposed in a slanted side tube of said grip such that an inner end of said actuation rod is located in said locating slot of said action rod, and that an outer end of said actuation rod is extended out of said water channel of said grip via said slanted side tube; and a trigger pivoted to said grip such that said trigger is in contact with said outer end of said actuation rod whereby said trigger is activated by an external force such that said inner end of said actuation rod causes said action rod to displace, thereby resulting in separation of said stop edge of said action rod from said arresting surface of said water channel of said grip;

wherein said flow control device comprises:

a housing which is fastened between the top end of said grip and the inner end of said barrel and is provided with an upper through hole corresponding in location to said water channel of said barrel, and with a lower through hole corresponding in location to said water channel of said grip;

a control tube rotatably disposed in said housing and provided in an inner end with an upper through hole opposite to said upper through hole of said housing, said control tube further provided in the inner end with a lower through hole opposite to said lower through hole of said housing, said control tube further provided therein with a spring whereby said spring urges at one end thereof an inner wall of an outer end of said control tube such that other end of said spring urges an inner wall of an inner end of said housing; and a control knob fastened with the outer end of said control tube for turning said control tube in such a way that said upper through hole and said lower through of said control tube are in a complete or partial alignment with said upper through hole and said lower through of said housing.

* * * * *